US009184501B2

(12) United States Patent
Andrenko

(10) Patent No.: US 9,184,501 B2
(45) Date of Patent: Nov. 10, 2015

(54) MULTIBAND ANTENNA

(75) Inventor: Andrey S Andrenko, Kawasaki (JP)

(73) Assignee: FUJITSU LIMITED, Kawasaki (JP)

( * ) Notice: Subject to any disclaimer, the term of this patent is extended or adjusted under 35 U.S.C. 154(b) by 219 days.

(21) Appl. No.: 13/982,400

(22) PCT Filed: Feb. 14, 2011

(86) PCT No.: PCT/JP2011/000807
§ 371 (c)(1),
(2), (4) Date: Jul. 29, 2013

(87) PCT Pub. No.: WO2012/111037
PCT Pub. Date: Aug. 23, 2012

(65) Prior Publication Data

US 2013/0307753 A1 Nov. 21, 2013

(51) Int. Cl.

| | |
|---|---|
| ***H01Q 1/24*** | (2006.01) |
| ***H01Q 5/00*** | (2015.01) |
| ***H01Q 1/38*** | (2006.01) |
| ***H01Q 9/42*** | (2006.01) |
| ***H01Q 5/321*** | (2015.01) |
| ***H01Q 5/371*** | (2015.01) |
| ***H01Q 5/378*** | (2015.01) |

(52) U.S. Cl.
CPC ..... *H01Q 5/0062* (2013.01); *H01Q 1/243* (2013.01); *H01Q 1/38* (2013.01); *H01Q 5/321* (2015.01); *H01Q 5/371* (2015.01); *H01Q 5/378* (2015.01); *H01Q 9/42* (2013.01)

(58) Field of Classification Search
CPC ..... H01Q 1/243; H01Q 5/0062; H01Q 1/38; H01Q 5/378; H01Q 5/321; H01Q 5/371; H01Q 9/42
USPC ..... 343/702, 700 MS
See application file for complete search history.

(56) References Cited

U.S. PATENT DOCUMENTS 7,026,999 B2 * 4/2006 Umehara et al. ..... 343/702
(Continued)

FOREIGN PATENT DOCUMENTS

JP 2006-54639 A 2/2006
JP 2011-015034 1/2011

OTHER PUBLICATIONS

Wong, Kin-Lu "PIFAs for Internal Mobile Phone Antennas," Planar Antennas for Wireless Communications; Wiley Series in Microwave and Optical Engineering, copyright 2003, Chapter 2; (pp. 26-69), John Wiley & Sons, Hoboken, New Jersey.
(Continued)

*Primary Examiner* — Hoanganh Le
(74) *Attorney, Agent, or Firm* — Fujitsu Patent Center

(57) ABSTRACT

The reconfigurable multiband antenna includes the main antenna element connected to a feeding point to receive and transmit a radio signal, the at least one parasitic antenna element being placed on the side of the main antenna element. The at least one parasitic antenna is connected to the main antenna element or they are connected to each other by at least one RF switch. By changing the ON-OFF combination of the RF switches, the connection between the main antenna element and the parasitic antenna element is changed, thereby changing the resonance frequencies of the entire antenna. By this technique, the entire antenna functions as a reconfigurable multiband antenna.

10 Claims, 11 Drawing Sheets

(56) References Cited

U.S. PATENT DOCUMENTS

| | | | | |
|---|---|---|---|---|
| 7,319,432 | B2 * | 1/2008 | Andersson | 343/702 |
| 8,339,321 | B2 * | 12/2012 | Nagano et al. | 343/702 |
| 8,699,964 | B2 * | 4/2014 | Ohba et al. | 455/77 |
| 2004/0041734 | A1 * | 3/2004 | Shiotsu et al. | 343/702 |
| 2007/0035458 | A1 * | 2/2007 | Ohba | 343/702 |
| 2008/0238794 | A1 | 10/2008 | Pan et al. | |
| 2012/0013511 | A1 * | 1/2012 | Sumi et al. | 343/702 |

OTHER PUBLICATIONS

Japan Patent Office—ISA/JP; International Search Report mailed in connection with PCT/JP2011/000807, on May 17, 2011 (PTO Form/ISA/210).

Extended European Search Report dated Feb. 11, 2014 issued in corresponding European Patent Application No. 11858500.9, 5 pages.

* cited by examiner

MULTIBAND ANTENNA

TECHNICAL FIELD

The embodiments described below relate to a multiband antenna.

BACKGROUND ART

There is an increasing demand for compact antennas designed for handset and wireless terminal applications. New wireless devices are required to operate at different frequency bands corresponding to various communication services, such as GSM, UMTS, GPS, Wi-Fi, WIMAX, etc.

Therefore, antennas for novel wireless terminals are required to be able to change the frequency at which they operate depending on the device communication service being activated. At the same time, it is desirable that the antenna elements be as small and lightweight as possible and that they satisfy the design requirements for antenna gain and efficiency.

In a multiband antenna for mobile handsets and wireless terminal applications, the following are required:

- Compactness of antenna elements so that they fit in a limited volume inside the phone or wireless terminal, and
- An ability to provide the frequency change across closely allocated bands as well as to provide multiband frequency operation for different wireless communication services.

In the conventional technology, a patch antenna is known as a candidate for a wideband/multiband antenna for mobile handsets. Also, other types of conventional antennas are known, and many patent applications have been filed for these types of a wideband/multiband antennas. For the various types of conventional antennas, refer to non-patent document 1.

CITATION LIST

Non Patent Literature

NPL 1: Kin-Lu Wong, "Planar Antennas for Wireless Communications", John Wiley & Sons, Inc., NJ, USA, 2003.

SUMMARY OF INVENTION

In the embodiments described below, a reconfigurable multiband antenna for application to mobile handsets and wireless terminals is to be provided.

According to an aspect of the embodiment described below, the multiband antenna is structured so as to include: a first antenna element connected to a radio feeding point to transmit and receive radio signals; at least one second antenna element; and a switching unit placed between the first antenna element and the at least one second antenna element that changes an electrical length of the first antenna element by being turned ON, thereby connecting the at least one second antenna element to the first antenna element.

According to the embodiments described below, a reconfigurable multiband antenna for application to mobile handsets and wireless terminals is provided

DESCRIPTION OF EMBODIMENTS

Figure 1:
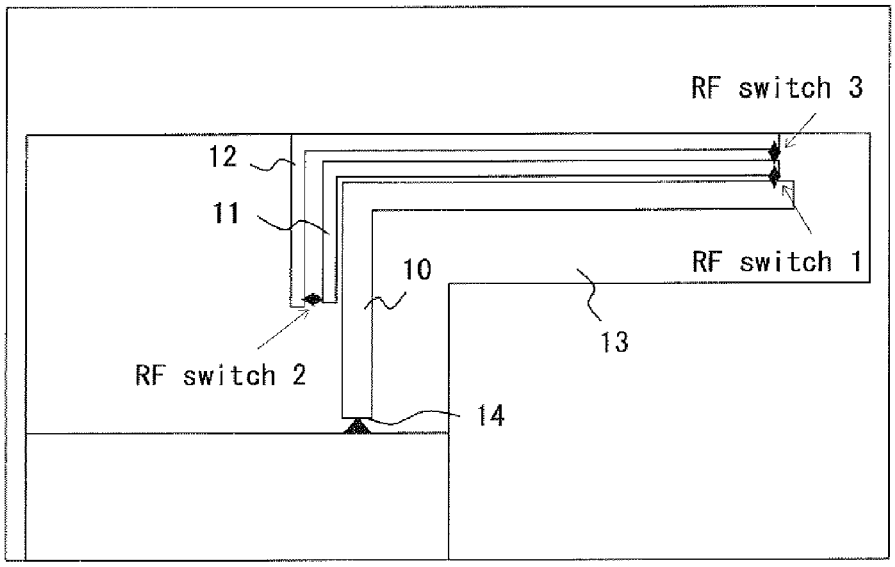
FIG. 1 illustrates the first configuration of a reconfigurable multiband antenna of the embodiment.

The embodiment relates generally to antennas, and particularly to a reconfigurable antenna for mobile handsets and wireless terminals operating at different frequency bands.

In the conventional antenna, band-pass filters are required in order to eliminate unused signals outside of the frequency band used for communication because the conventional antenna receives a broader frequency band than the needed frequency band. On the other hand, the antenna of the embodiment is reconfigurable such that it can be enabled to tune to the used frequency band only. Therefore, the reconfigurable antennas of the embodiment, as opposed to the conventional wideband/multiband antennas, do not require band-pass filters in feeding lines, which simplifies the system design. The reconfigurable antenna of the embodiment utilizes electromagnetic coupling from the main printed strip element to the parasitic strip elements and utilizes RF switches being used to change the electrical length of antenna segments to alter the antenna operating frequencies. By activating and de-activating the RF switches, the frequency of antenna operation can be easily changed.

The embodiment uses a coupled antenna element with dual-band (triple-band) operation, an additional RF-switch activated antenna element, and RF switches directly integrated into antenna elements to alter the resonance length and frequency of antenna operation.

The reconfigurable antenna according to one aspect of the embodiments may be configured to include at least a subcombination of the following:

- a dielectric substrate on which the antenna elements are printed,
- the antenna comprising a main antenna element and at least one parasitic antenna element coupled to the main antenna element, the length of the parasitic antenna element being different from the main antenna element while the reconfigurable antenna has at least one 90-deg turn of both main and parasitic antenna elements to improve antenna impedance matching in multiple frequency bands, the reconfigurable antenna incorporating at least one parasitic antenna element being activated by RF switches, several RF switches providing On-Off operation between the main antenna element and the at least one parasitic antenna element, the locations of said RF switches are chosen so as to alter the current distribution in the main antenna element and the at least one parasitic antenna element and to change the resonance frequencies of the reconfigurable antenna including the main antenna element and the at least one parasitic antenna element, the combination of On/Off states of the RF switches is selected so as to change the electrical length of the reconfigurable antenna and to provide the multiple frequencies of antenna operation, the main antenna element and the at least one parasitic antenna element are coplanar strips printed on the substrate, the bias networks (control circuits) of the RF switches are printed on the surface of the substrate housing the entire antenna.

The design of the reconfigurable antenna of the embodiment results in a compact design of multiband antennas operating at multiple frequencies by activating/deactivating the RF switches.

In contrast to prior art multiband antenna solutions, the design of the embodiment utilizes RF switches directly integrated into an antenna layout rather than on the feed line. It makes the design of the reconfigurable antenna more compact. The design of the embodiment uses coupled antenna elements with multiband capability and RF switches placed at the specific points so as to provide an electrical length at each of the multiple operation frequencies when they are activated to alter the antenna current distribution.

An On/Off state combination is also selected so as to control antenna frequencies. The embodiment allows the freedom to realize various antenna designs, such as a combination of the main antenna element, a single parasitic antenna element being connected to the main antenna element by an RF switch being turned OFF, and a single parasitic antenna element being coupled to the main antenna element by an RF switch being turned ON, a combination of the main antenna element and two parasitic antenna elements being connected to each other by RF switches being turned OFF, a combination of the main antenna element and two parasitic antenna elements being connected to each other by RF switches being turned ON, etc.

A variety of RF switches could be used in this design, such as PIN-diodes, switched capacitor RF switches, RF MEMS (Micro Electro-Mechanical System) switches, etc. The various types of RF switches are well known in the art. For example, many commercially available RF switches can be found on the Internet.

FIG. 1 illustrates the first configuration of a reconfigurable multiband antenna of the embodiment.

The reconfigurable multiband antenna of FIG. 1 includes a main antenna element 10, the first parasitic antenna element 11, the second parasitic antenna element 12, RF switch 1, which couples the main antenna element 10 and the first parasitic antenna element 11, and RF switches 2 and 3, which couple the first parasitic antenna element 11 and the second parasitic antenna element 12 at different points. All of the above antenna elements are printed on the substrate 13 as coplanar strips. Further, control circuits of RF switches 1 through 3 (not illustrated) are also contained in a printed circuit on the substrate 13. The first parasitic antenna element 11 is placed adjacent to the main antenna element 10 and the second parasitic antenna element 12 is placed adjacent to the first parasitic antenna element 11. Physical lengths of the main antenna element 10, the first parasitic antenna element 11, and the second parasitic antenna element 12 may be different from each other.

Radio signals to be sent out from the reconfigurable antenna are fed from feeding point 14. When all RF switches 1 through 3 are turned OFF, the main antenna element 10, the first parasitic antenna element 11, and the second parasitic antenna element 12 become independent antenna elements. However, when electric current flows in the main antenna element 10, all antenna elements 10, 11 and 12 are electromagnetically coupled to each other because of electromagnetic induction. Electromagnetically coupled antenna elements 10, 11 and 12 have a different resonance frequency from that of the main antenna element 10 used alone.

The main antenna element 10 has a 90-degree turn and the first and second parasitic antenna elements 11 and 12 also have 90-degree turns along the main antenna element 10. The 90-degree turn of the main antenna element 10 causes a broadening of a radiation field at the 90-degree turn because of a 90-degree turn of an electric current in the main antenna element 10. This broadening of the radiation field enables electromagnetic coupling between antenna elements 10, 11 and 12 that is more effective than when there is no 90-degree turn. Therefore, the main antenna element 10 along with the first and second parasitic antenna elements 11 and 12 may have at least one 90-degree turn in the embodiment.

When RF switch 1 is turned ON and RF switches 2 and 3 are turned OFF, the main antenna element 10 and the first parasitic antenna element 11 are connected and become a single antenna element, the electrical length of which is longer than that of the main antenna element 10. Therefore, the antenna element in which the main antenna element 10 and the first parasitic antenna element 11 are connected has a different resonance frequency than the case where the main antenna element 10 and the first parasitic antenna element 11 are not connected, inducing a different frequency band for radio transmission. Although the second parasitic antenna element 12 is not connected to the first parasitic antenna element 11, electromagnetic coupling occurs between the first parasitic antenna element 11 and the second parasitic antenna element 12. Therefore, the second parasitic antenna element 12 contributes to a construction of a frequency band for radio transmission.

When RF switches 1 and 2 are turned ON and RF switch 3 is turned OFF, the main antenna element 10, the first parasitic antenna element 11, and the second parasitic antenna element 12 are connected, constructing a single antenna element. As the electrical length of the single antenna element is different from the electrical length of an antenna element obtained by connecting only the main antenna element 10 and the first parasitic antenna element 11, a further different frequency band for a radio transmission is obtained.

When all RF switches 1 through 3 are turned ON, the first parasitic antenna element 11 and the second parasitic antenna element 12 are connected at two points, inducing different current distribution in the antenna element than the case when RF switches 1 and 2 are turned ON and RF switch 3 is turned OFF. Therefore, a still further different frequency band for radio transmission is obtained.

Figure 2:
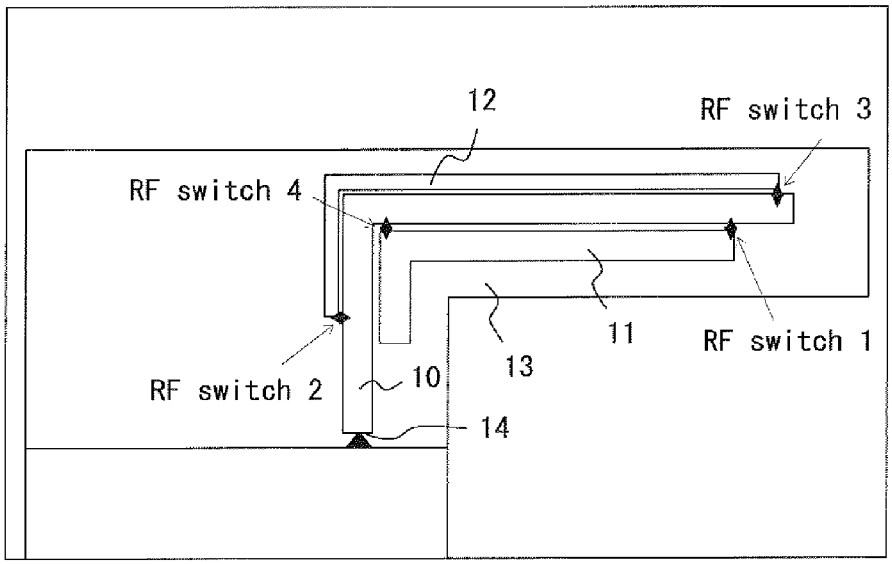
FIG. 2 illustrates the second configuration of a reconfigurable multiband antenna of the embodiment.

FIG. 2 illustrates the second configuration of a reconfigurable multiband antenna of the embodiment.

In FIG. 2, like elements to those in FIG. 1 are given like numerals to those in FIG. 1 and their explanation is omitted.

In FIG. 2, the first parasitic antenna element 11 and the second parasitic antenna element 12 are placed adjacent to the main antenna element 10. RF switches 1 and 4 are provided to connect the main antenna element 10 and the first parasitic antenna element 11. RF switches 2 and 3 are provided to connect the main antenna element 10 and the second parasitic antenna element 12. All antenna elements are printed on the substrate 13 as coplanar strips. Further, control circuits of RF switches 1 through 4 (not illustrated) are also contained in a printed circuit on the substrate 13. Physical lengths of the main antenna element 10, the first parasitic antenna element 11, and the second parasitic antenna element 12 may be different from each other.

The main antenna element 10 along with the first parasitic antenna element 11 and the second parasitic antenna element 12 has one 90-degree turn.

As the second parasitic antenna element 12 is directly connectable to the main antenna element 10 and the first parasitic antenna element 11 and the second parasitic antenna element 12 are placed differently than in the first configuration of FIG. 1, an obtained frequency band for radio transmission becomes different from that of the first configuration of FIG. 1.

RF switch 4 is placed at the middle point of the first parasitic antenna element 11. When RF switch 4 is turned ON, current flow branches at RF switch 4 in the first parasitic antenna element 11. This branching of current flow causes a different current distribution in the first parasitic antenna element 11, inducing a different frequency band for radio transmission than when RF switch 4 is placed at the end portion of the first parasitic antenna element 11.

In FIG. 2, the first parasitic antenna element 11 is connected to the main antenna element 10 at two locations by RF switches 1 and 4 and the second parasitic antenna element 12 is connected to the main antenna element 10 at two locations by RF switches 2 and 3. By connecting the first and second parasitic antenna elements 11 and 12 to the main antenna element 10 at two locations via RF switches 1 through 4 being turned ON, electric current distribution in the antenna elements 10, 11 and 12 becomes different from the case where the first and second parasitic antenna elements 11 and 12 are respectively connected to the main antenna element 10 at one location, via one of RF switches 1 and 4 and one of RF switches 2 and 3 being turned ON. Then, different frequency bands for radio transmission are obtained for both cases.

Therefore, the geometry of antenna elements (the main antenna element 10 and at least one parasitic antenna element (for example, 11 and 12)) and the number and the locations of RF switches which are turned ON affect resonance frequencies used as frequency bands for radio transmission. The desirable geometry of antenna elements and the desirable number and the desirable locations of RF switches which are turned ON may be designed by experiment or simulation conducted by a designer. Specifically, although FIGS. 1 and 2 illustrate two parasitic antenna elements, only one parasitic antenna element or more than two parasitic antenna elements may be employed.

Figure 3:
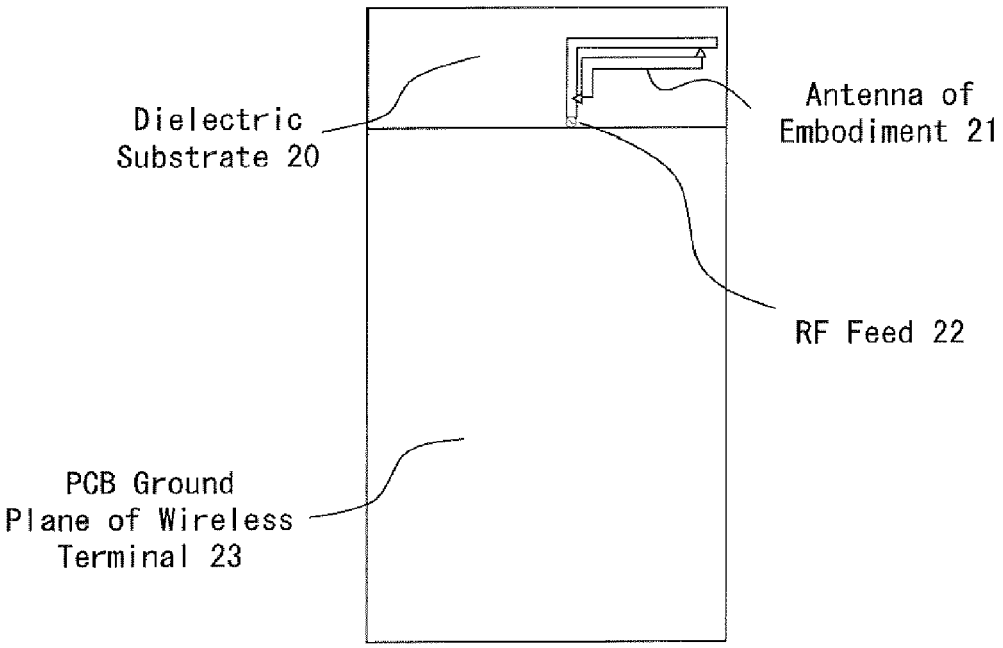
FIG. 3 illustrates an overview of an antenna configuration in a wireless terminal.

FIG. 3 illustrates an overview of an antenna configuration in a wireless terminal.

The reconfigurable multiband antenna of the embodiment 21 is printed on the dielectric substrate 20. The antenna of the embodiment 21 is connected to RF feed 22 and a PCB (Printed Circuit Board) ground plane of a wireless terminal 23, which is also printed on the dielectric substrate 20.

The transceiver (not illustrated) which transmits and receives a radio signal through the antenna of the embodiment 21 is connected at RF feed 22 and is placed on PCB ground plane 23. The other circuits (not illustrated) which provide functions as a wireless terminal are also placed on PCB ground plane 23.

Figure 4:
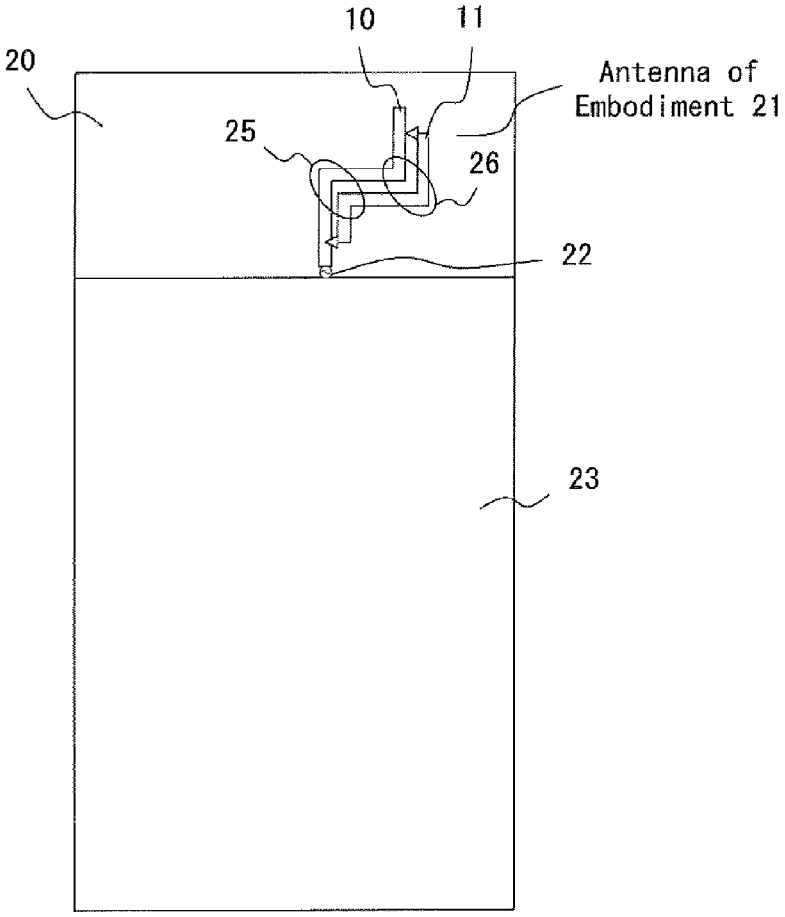
FIG. 4 illustrates an example of the reconfigurable multiband antenna of the embodiment with two 90-degree turns.

FIG. 4 illustrates an example of the reconfigurable multiband antenna of the embodiment with two 90-degree turns.

In FIG. 4, like elements to those in FIGS. 1 and 3 are given like numerals to those in FIGS. 1 and 3 and their explanation is omitted.

In FIG. 4, the antenna of the embodiment 21 has two 90-degree turns at points 25 and 26. At a 90-degree turn, the electric current turns along the main antenna element 10. At this time, the outside radiation field broadens due to a change in the flow of the electric current. Via the broadening of the radiation field, the radiation field in the first parasitic antenna element 11 becomes easy to penetrate, causing the electromagnetic coupling between the main antenna element 10 and the first parasitic antenna element 11 to be more effective. This enables the designer to have greater freedom in design, where broader frequency band adjustments may be achieved by adjusting the geometry of antenna elements. The number of 90-degree turns is not limited to two. Rather, more than two 90-degree turns may be included in the geometry of the antenna elements.

FIGS. 5A through 8B illustrate gain radiation patterns for the reconfigurable multiband antenna of the embodiment.

In FIGS. 5A through 8B, gain radiation patterns of the reconfigurable multiband antenna of FIG. 2 are illustrated. FIG. 5B illustrates a relationship between axes in gain radiation patterns and a direction in which the antenna of FIG. 2 is placed.

Figure 5A:
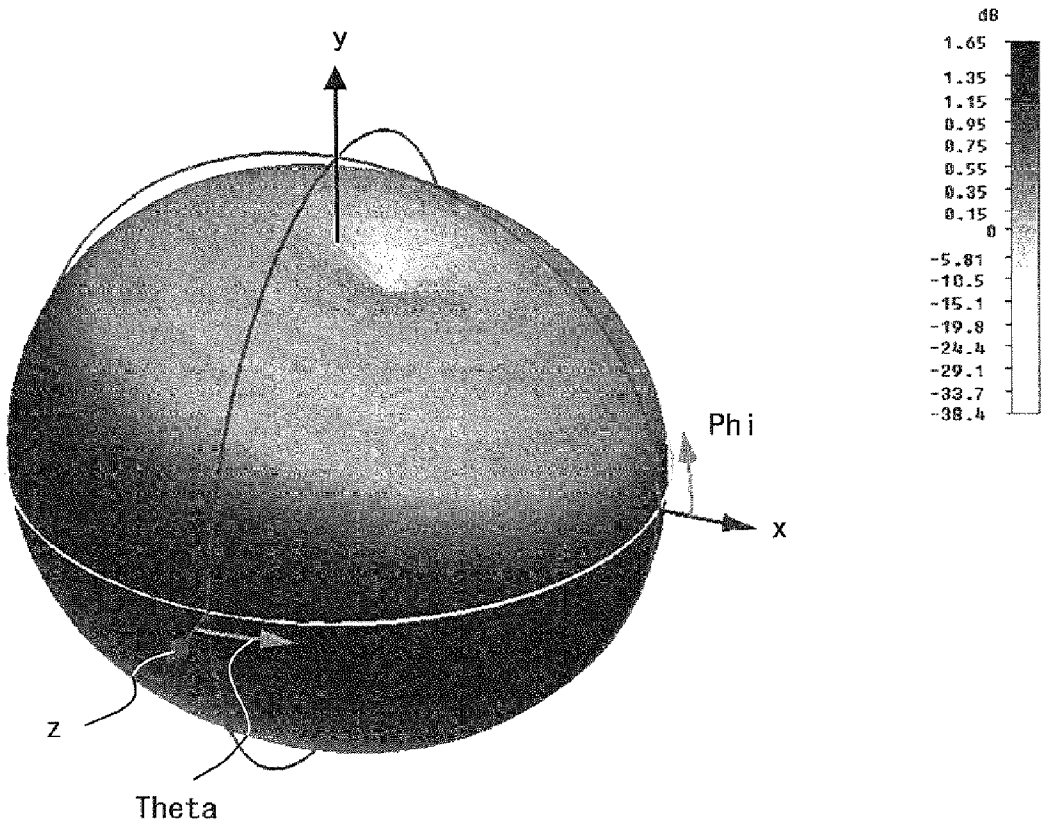
FIG. 5A illustrates gain radiation patterns for the reconfigurable multiband antenna of the embodiment.
Figure 5B:
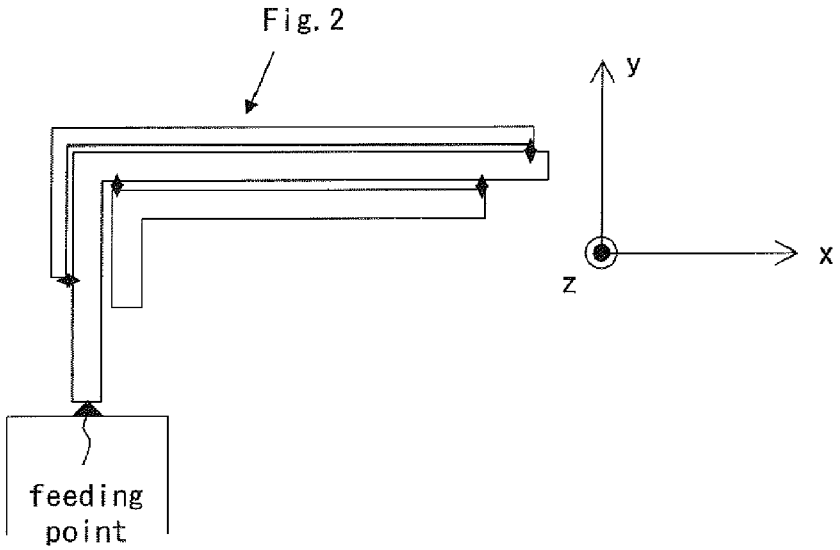
FIG. 5B illustrates gain radiation patterns for the reconfigurable multiband antenna of the embodiment.

As in FIG. 5B, the antenna of FIG. 2 lies in the x-y plane, and the antenna extends from the feeding point in an upward direction along the y-axis and then turns rightward along the x-axis. The z-axis is perpendicular to the plane on which the antenna lies.

In FIG. 5A, RF switches 1 and 3 of FIG. 2 are turned ON, RF switches 2 and 4 of FIG. 2 are turned OFF, and radiation at 905 MHz is shown. The darker portion of the gain radiation pattern indicates a stronger intensity of radiation.

In FIG. 5A, a perpendicular direction to the plane on which the antenna lies has a maximum intensity of radiation. As a whole, the radiation pattern of FIG. 5A reproduces that of a usual antenna in the conventional technology, which means that the configuration of the antenna of the embodiment functions well in spite of the addition of the structure of the embodiment.

Figure 6A:
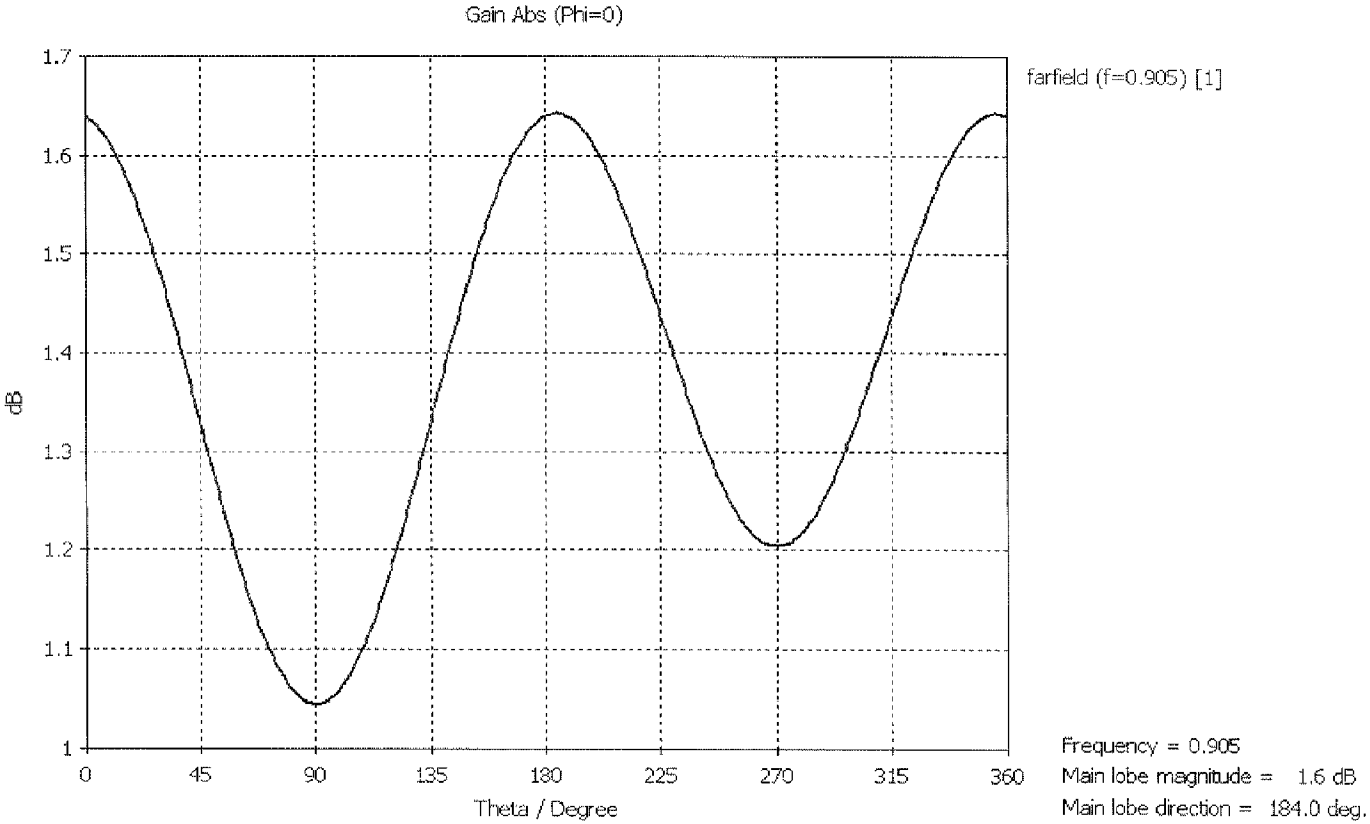
FIG. 6A illustrates gain radiation patterns for the reconfigurable multiband antenna of the embodiment.

FIG. 6A illustrates a cross-sectional view of the gain radiation pattern of FIG. 5A in the plane phi=0 (degrees) as shown in FIG. 5A, in the angular direction. In FIG. 6A, a horizontal axis indicates the theta direction in degrees as in FIG. 5A and a vertical axis indicates the far field radiation gain in dB. The direction in which theta=0 (degrees) is the z-axis direction. According to FIG. 6A, it is shown that the directions in which theta ? 0 (degrees) and theta ? 180 (degrees) have a peak intensity of radiation.

Figure 6B:
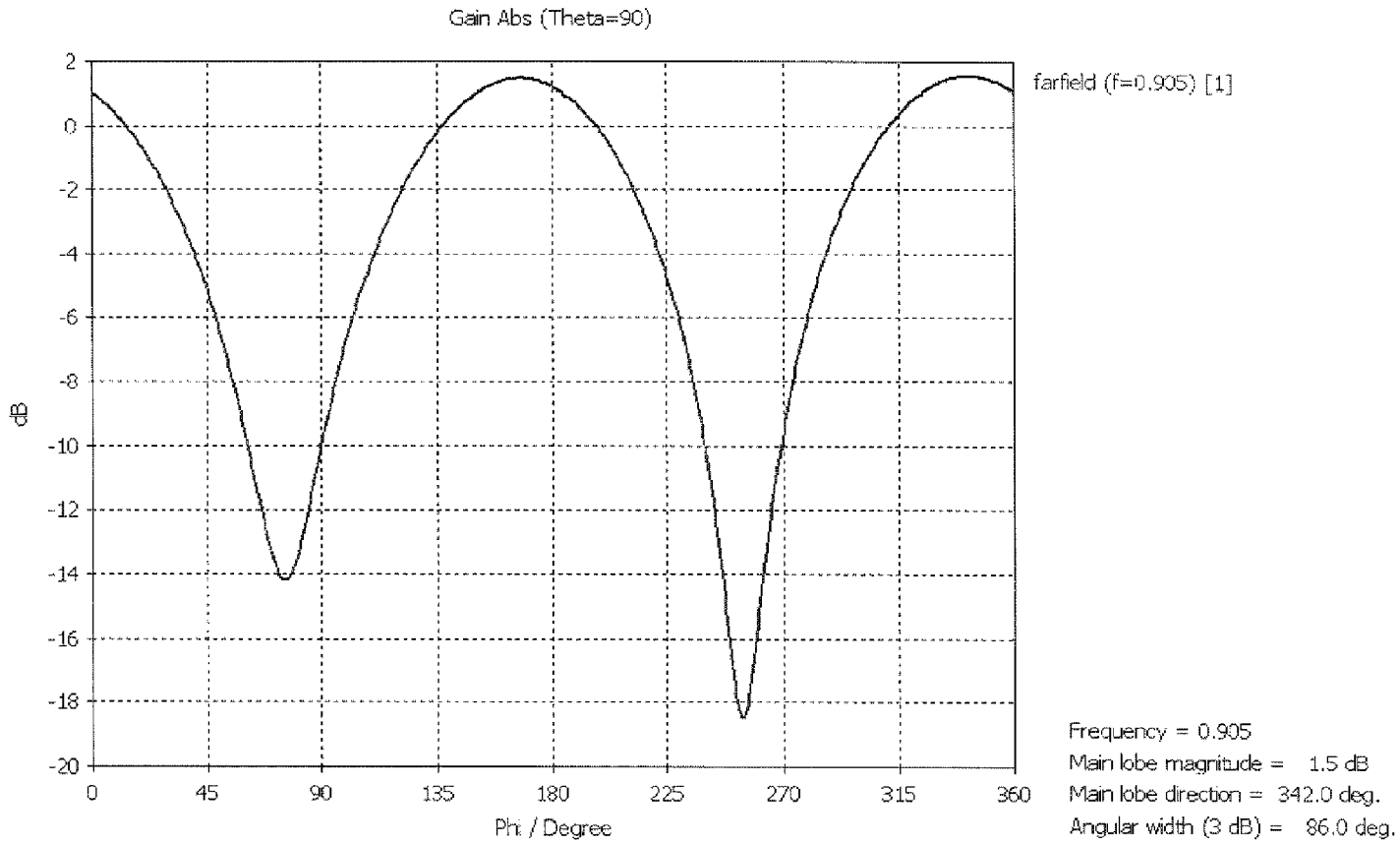
FIG. 6B illustrates gain radiation patterns for the reconfigurable multiband antenna of the embodiment.

FIG. 6B illustrates a cross-sectional view of the gain radiation pattern of FIG. 5A in the plane theta=90 (degrees) as shown in FIG. 5A, in the angular direction. In FIG. 6B, a horizontal axis indicates the phi direction in degrees as in FIG. 5A and a vertical axis indicates a far field radiation gain in dB. A direction in which phi=0 (degrees) is the x-axis direction. According to FIG. 6B, it is shown that the directions in which phi ? 0 (degrees) and phi ? 180 (degrees) have a peak intensity of radiation.

Figure 7:
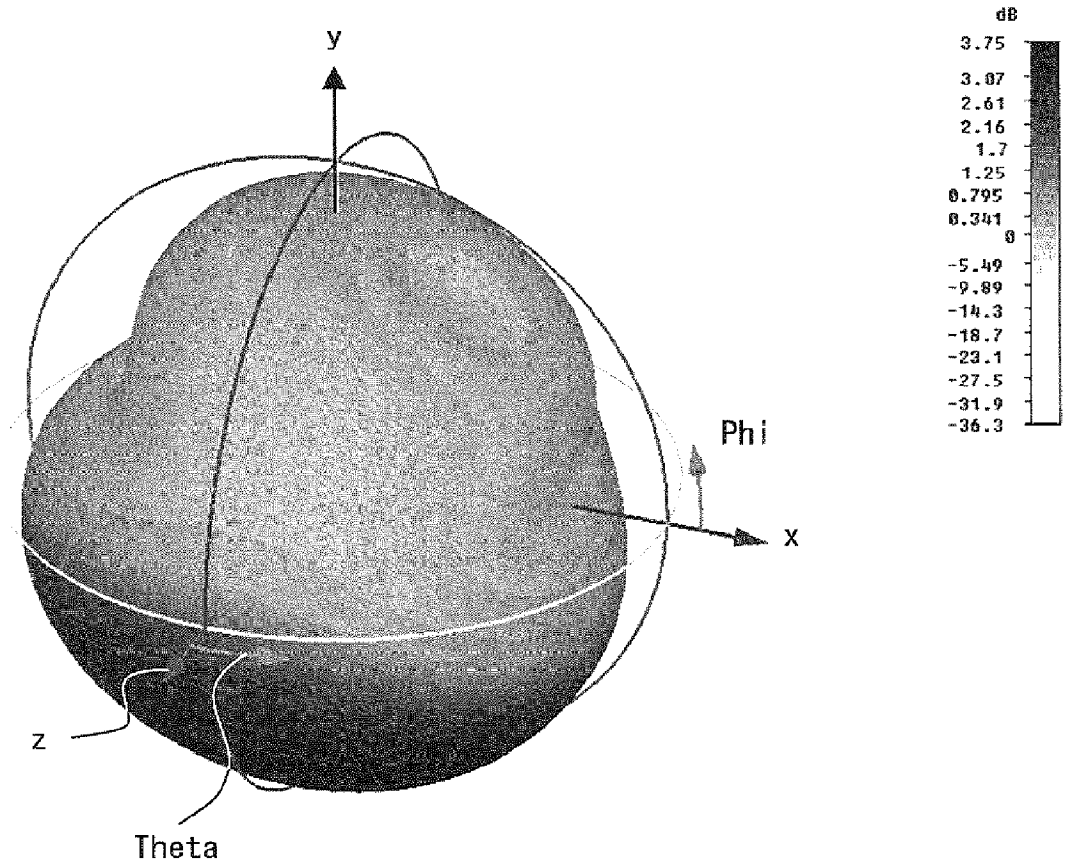
FIG. 7 illustrates gain radiation patterns for the reconfigurable multiband antenna of the embodiment.

FIG. 7 illustrates a gain radiation pattern at 1945 MHz. The antenna configuration and the relationship between axes and a direction of the antenna are the same as in FIG. 5B.

Although a shape of the gain radiation pattern is slightly deformed, the gain radiation pattern of FIG. 7 closely reproduces that of the normal antenna in the conventional technology, which means that the antenna of the embodiment functions well as an antenna for radio transmission in spite of the addition of the structure of the embodiment.

Figure 8A:
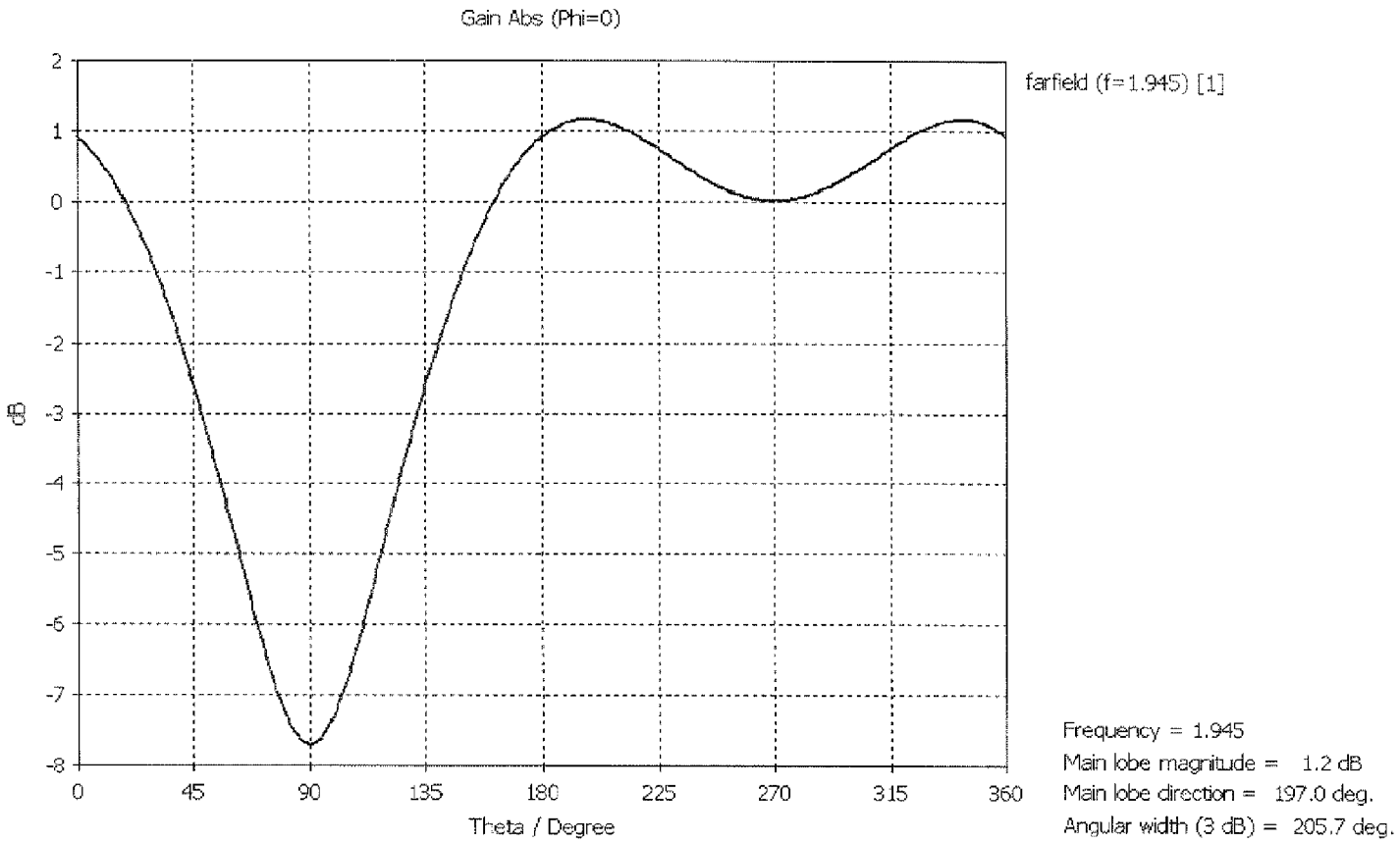
FIG. 8A illustrates gain radiation patterns for the reconfigurable multiband antenna of the embodiment.

FIG. 8A illustrates a cross-sectional view of the gain radiation pattern of FIG. 7 in the plane phi=0 (degrees) as shown in FIG. 7, in the angular direction. In FIG. 8A, a horizontal axis indicates the theta direction in degrees as in FIG. 7 and a vertical axis indicates far field radiation gain in dB. A direction in which theta=0 (degrees) is a z-axis direction. According to FIG. 8A, it is shown that the directions in which theta ?0 (degrees) and theta ?180 (degrees) have a peak intensity of radiation.

Figure 8B:
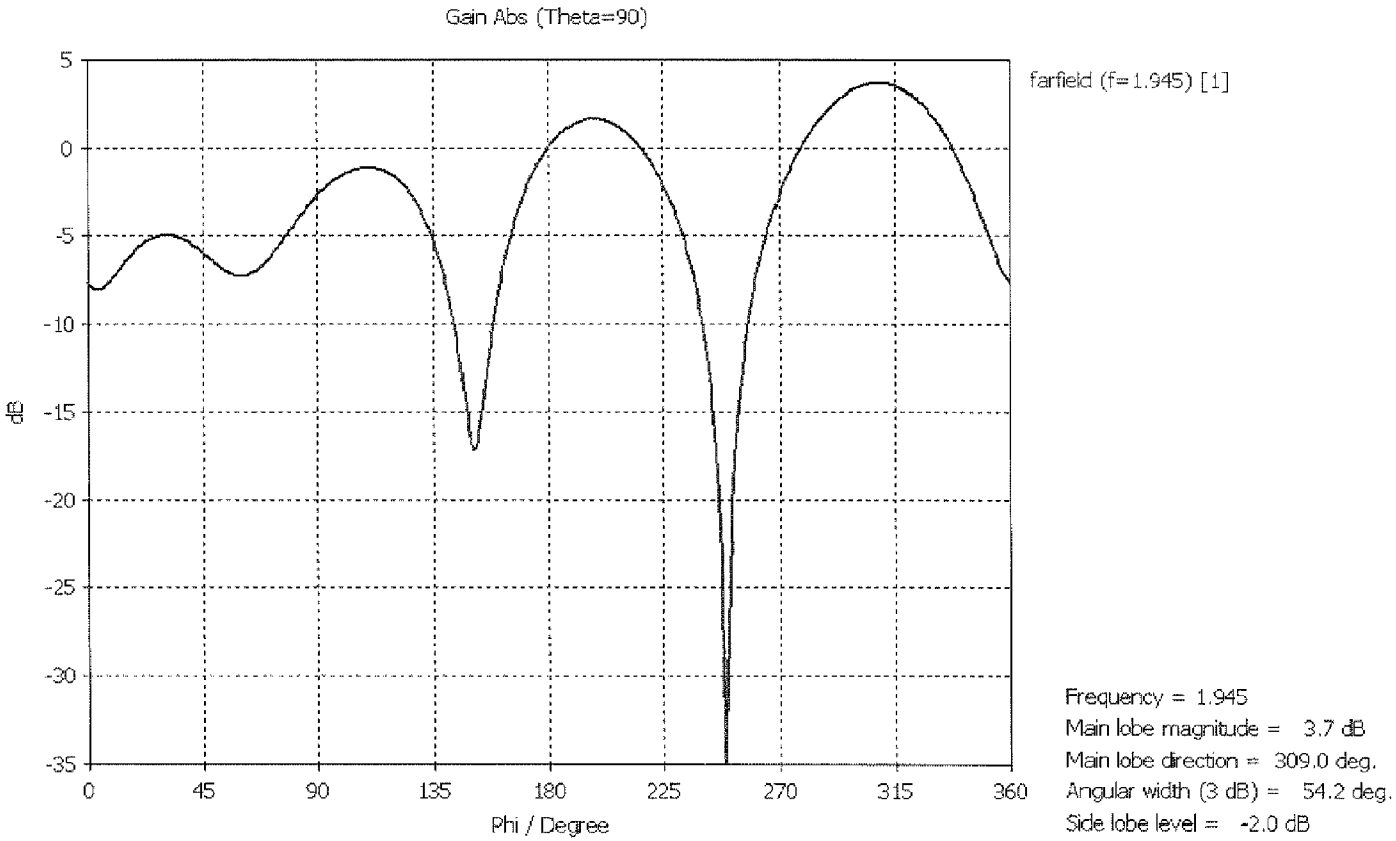
FIG. 8B illustrates gain radiation patterns for the reconfigurable multiband antenna of the embodiment.

FIG. 8B illustrates a cross-sectional view of the gain radiation pattern of FIG. 7 in the plane theta=90 (degrees) as shown in FIG. 7, in the angular direction. In FIG. 8B, a horizontal axis indicates the phi direction in degrees, as in FIG. 7, and a vertical axis indicates a far field radiation gain in dB. A direction in which phi=0 (degrees) is the x-axis direction. According to FIG. 8B, it is shown that the directions in which phi ? 100 (degrees), phi ? 200 (degrees) and phi ? 300 (degrees) have a peak intensity of radiation.

Figure 9A:
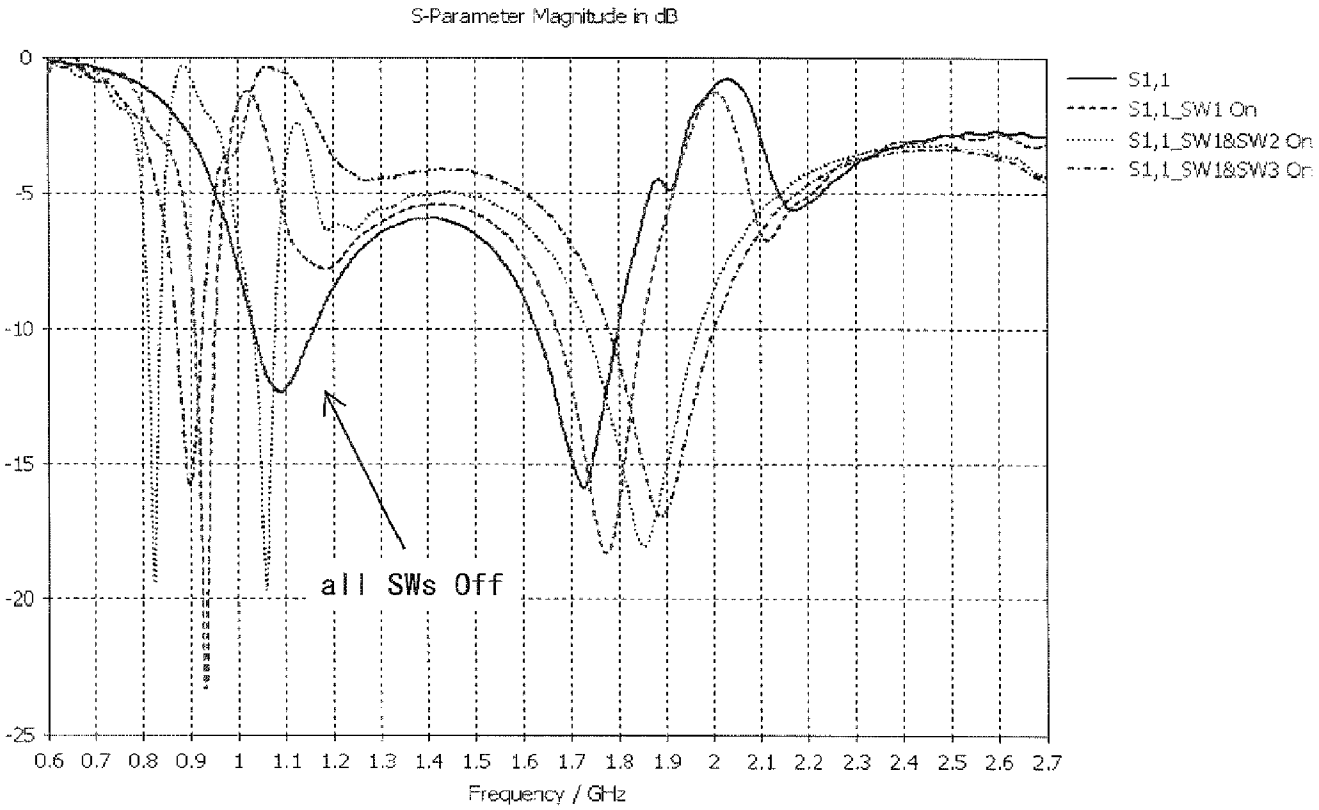
FIG. 9A illustrates the magnitude of an S-11 parameter for different combinations of ON and OFF of RF switches of the antenna of the embodiment.
Figure 9B:
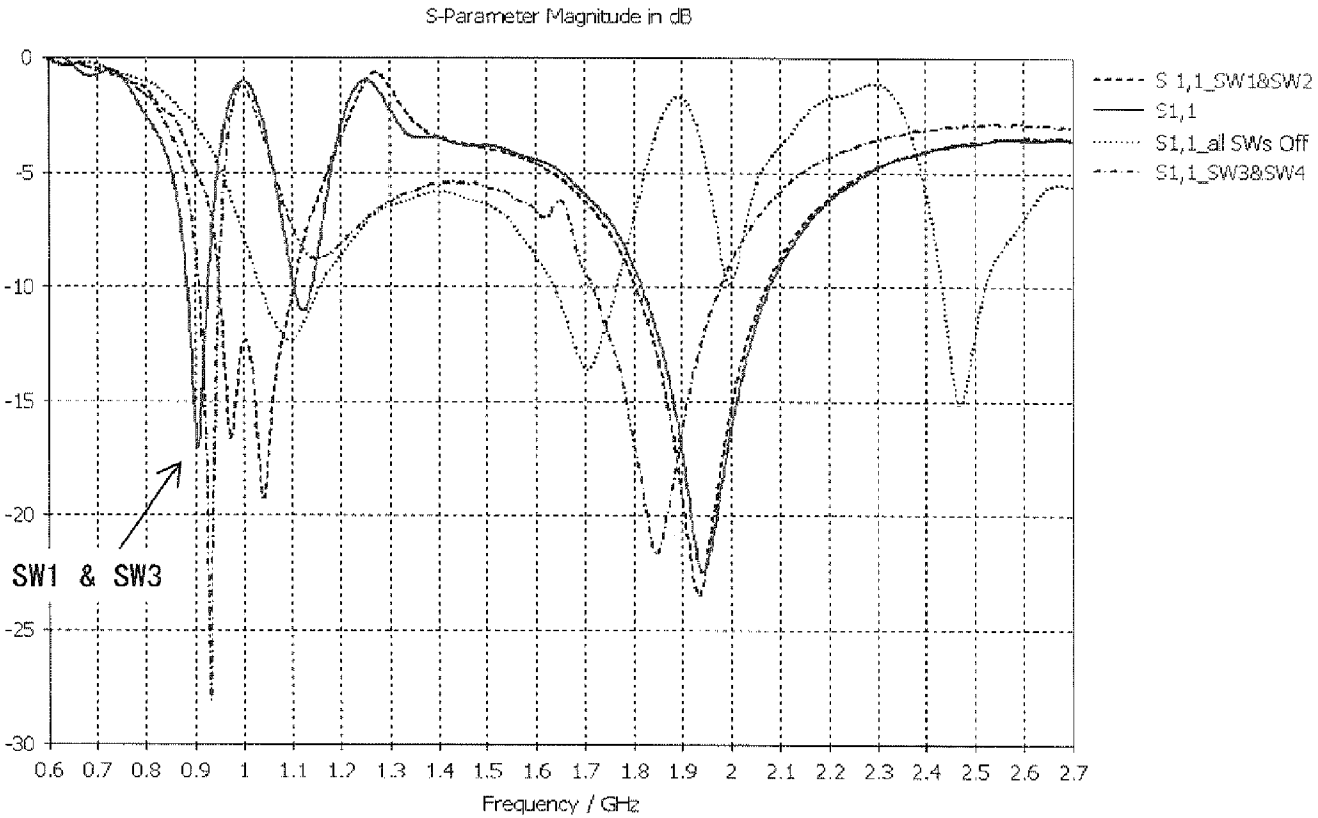
FIG. 9B illustrates the magnitude of an S-11 parameter for different combinations of ON and OFF of RF switches of the antenna of the embodiment.

FIGS. 9A and 9B illustrate the magnitude of S-11 parameter for different combinations of ON and OFF of RF switches of the antennas of the embodiment.

FIG. 9A is for the antenna of FIG. 1 and FIG. 9B is for the antenna of FIG. 2. A horizontal axis indicates frequency in GHz and a vertical axis indicates S-11 parameter magnitude in dB.

The magnitude of the S-11 parameter indicates the intensity of a returning signal, which is a signal reflected back at an open end of the antenna. The smaller the magnitude of the S-11 parameter is, the stronger the intensity of radiation emitted from the antenna.

According to FIGS. 9A and 9B, it is understood that by changing the ON-OFF combination of the RF switches, the number of minima and the depths of the minima of the S-11 parameter magnitude change. The deeper the depth of minima, the more efficient the radiation becomes. Further, if the number of minima is increased, the number of frequency bands for radio transmission of the antenna increases. This indicates that the radiation characteristic of the antenna is changeable by changing the ON-OFF combination of the RF switches. This change of the radiation characteristic enables the reconfigurable multiband antenna to be realized.

In the above described embodiment, only a monopole antenna is illustrated. However, the same technique is applicable to a dipole antenna. In a dipole antenna, two main antenna elements are connected to the feeding point. In this case, a plurality of the parasitic antenna elements may be provided on the side of each of the main antenna elements. Further, the main antenna elements and the plurality of parasitic antenna elements are connected to each other by RF switches. By changing the ON-OFF combination of RF switches, the radiation characteristic of the dipole antenna is changed, thereby realizing a reconfigurable multiband antenna.

The invention claimed is:

1. A multiband antenna, comprising:

a first antenna element connected to a radio feeding point to transmit and receive radio signals, wherein the first antenna element has a turn;

a second antenna element which extends along the first antenna element in an extension direction of the first antenna element and turns along the turn of the first antenna element, wherein the second antenna element is not connected to a ground plane;

a third antenna element which extends along the first antenna element in the extension direction of the first antenna element and turns along the turn of the first antenna element, wherein the third antenna element is not connected to the ground plane; and a switching unit including a switch placed between the first antenna element and the second antenna element, the switching unit changing an electrical length of the first antenna element by being turned ON, thereby connecting the second antenna element to the first antenna element.

2. The multiband antenna according to claim 1, wherein the first antenna element, the second antenna element, the third antenna element, and the switching unit are printed on a dielectric substrate.

3. The multiband antenna according to claim 1, wherein the second antenna element and the third antenna element are placed alongside the first antenna element.

4. The multiband antenna according to claim 3, wherein the turn of the first antenna element is a 90-degree turn.

5. The multiband antenna according to claim 1, wherein the first antenna element has a physical length different from physical lengths of the second antenna element and the third antenna element.

6. The multiband antenna according to claim 1, wherein the switching unit includes another switch configured to connect the third antenna element to the first antenna element.

7. The multiband antenna according to claim 1, wherein the switching unit includes another switch configured to connect the third antenna element to the second antenna element.

8. The multiband antenna according to claim 1, wherein the switch is an RF switch.

9. The multiband antenna according to claim 1, wherein the first antenna element, the second antenna element, and the third antenna element are coplanar strips.

10. A wireless terminal equipped with the multiband antenna according to claim 1.

* * * * *